US007041919B2

(12) United States Patent
Nishimura et al.

(10) Patent No.: US 7,041,919 B2
(45) Date of Patent: May 9, 2006

(54) SWITCH HAVING RESILIENT OPERATING SECTION

(75) Inventors: Kenji Nishimura, Osaka (JP); Tamotsu Yamamoto, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 48 days.

(21) Appl. No.: 10/894,127

(22) Filed: Jul. 20, 2004

(65) Prior Publication Data

US 2005/0077161 A1 Apr. 14, 2005

(30) Foreign Application Priority Data

Oct. 8, 2003 (JP) ..... 2003-349249

(51) Int. Cl.
*H01H 15/00* (2006.01)

(52) U.S. Cl. ..... 200/61.41; 200/553; 200/339

(58) Field of Classification Search ..... 200/47, 200/61.41–61.43, 329, 339, 553, 557–559, 200/561

See application file for complete search history.

(56) References Cited

U.S. PATENT DOCUMENTS 3,594,519 A * 7/1971 Schmidlin ..... 200/61.41
5,276,426 A * 1/1994 LoBello ..... 340/436
5,769,209 A * 6/1998 Massey, III ..... 200/339

FOREIGN PATENT DOCUMENTS

JP 2001-184994 7/2001

* cited by examiner

*Primary Examiner*—Michael A. Friedhofer
(74) *Attorney, Agent, or Firm*—Wenderoth, Lind & Ponack, L.L.P.

(57) ABSTRACT

A switch includes a housing, an operating member placed in the housing, and contacting sections accommodated in the housing. The operating member has an operating section made of elastic material to be bowed in every direction and an operating unit coupled to the operating section. When greater force than necessary for changing a state of the contacting sections is applied to the operating section along an operating direction, or when force directed in a direction other than the operating direction is applied to the operating section, the operating section itself bows to absorb extra force.

6 Claims, 5 Drawing Sheets

SWITCH HAVING RESILIENT OPERATING SECTION

FIELD OF THE INVENTION

The present invention relates to a switch to be mounted in any of various electronic devices as an element of a sensing mechanism for sensing whether a shutter of a still camera or a display of a video-movie is open or closed, or whether a disc is present in a FDD device or not.

BACKGROUND OF THE INVENTION

Various sensing mechanisms employing switches have been widely used in many electronic devices in recent years. For instance, a typical sensing mechanism senses whether a shutter of a still camera is open or closed, or senses whether a display of a video movie camera is open or closed, or senses whether a disc remains in a FDD device or not.

As an element of the sensing mechanism, a variety of switches to be operated in different ways have been commercialized. For instance, an operating section of a switch is projected from a housing, and the projected section is tilted or pushed for changing the state of a contacting section placed in the housing. Removal of the operating force from the projected section will return the operating section to its original place.

Such a conventional switch is described hereinafter with reference to FIG. 10, which shows a perspective appearance of the conventional switch. In FIG. 10, housing 1 made of insulating resin has a recess open upward, and the opening is covered by cover 2. The recess accommodates a contacting section (not shown) of a self-reset switch. Operating lever 3 made of insulating resin and shaped like a straight rod protrudes upward slantingly, as an operating section of the switch, from the front section of housing 1.

Operating lever 3 is unitarily formed with an operating unit (not shown) accommodated in housing 1, and both of those elements form an operating member. A fulcrum section of the operating unit is rotatably supported in housing 1. The foregoing structure allows this conventional switch to tilt downward along the arrow mark shown in FIG. 10.

Tilting of lever 3 moves a pressing section of the operating unit, thereby changing a state of a contacting section placed in housing 1. Removal of the tilting force (operating force) returns the contacting section to its original location, and the recovery force returns lever 3 to its original state, i.e. in a slanting posture.

One of the prior art arrangements is disclosed in Japanese Patent Publication No. 2001-184994.

Since electronic devices have been downsized recently, the switches used therein have been required to be downsized. In particular, the switches used in the sensing mechanisms are required to be smaller in appearance, and to change a switch-state using a light operating force. On the other hand, since the switches are used in situations in which they are operated repeatedly, durability under frequent operation is required.

Under the foregoing circumstances, the conventional switches have been free from inconvenience and excellent in durability. However, when the device employing the switch is dropped, and an unexpected impact load is applied to an operating section (e.g. lever 3 in the foregoing case), the downsized operating section may be broken.

SUMMARY OF THE INVENTION

The switch of the present invention comprises the following elements:

a housing;

an operating member disposed in the housing; and a contacting section accommodated in the housing.

The operating member includes an operating section which is made of resilient material, protruded outside the housing, and can be bowed in any direction. The operating member also includes an operating unit coupled to the operating section.

The foregoing switch can have its contact state changed by an operating force being applied to the operating section via the operating unit, and the operating section can be returned to its original condition by removing the operating force.

When force greater than necessary for changing the contact state is applied to the operating section, or force directed in a direction other than the operating direction is applied, the operating section bows itself to absorb the extra force.

The foregoing structure allows the operating section to bow when excessive force is applied to the operating section. As a result, the impact of the force can dissipate, thereby preventing the operating section from being damaged.

Since the foregoing structure allows the operating section to bow for itself, the switch can cope with the situation where an operating section moves by an amount greater than a stroke set for changing a contact state, namely, the switch can be used with ease in an over-stroke application.

DETAILED DESCRIPTION OF PREFERRED EMBODIMENTS

Figure 1:
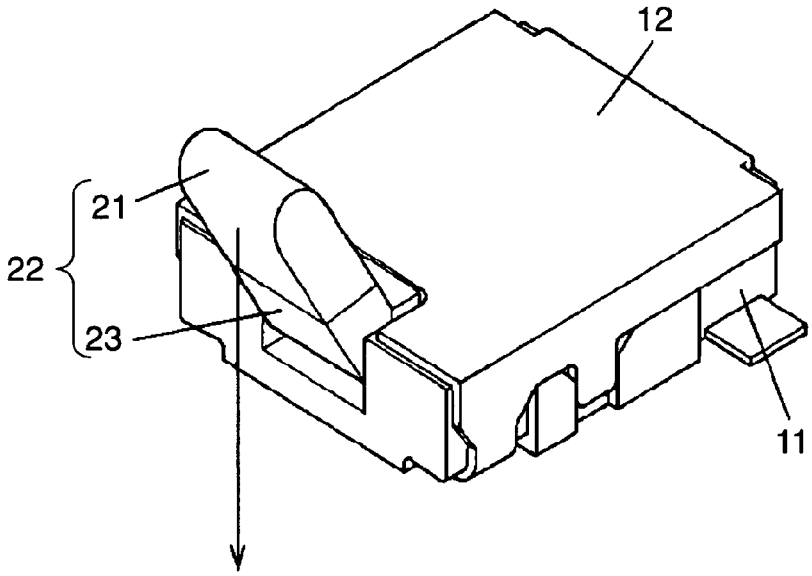
FIG. 1 shows a perspective appearance of a switch in accordance with an exemplary embodiment of the present invention.
Figure 2:
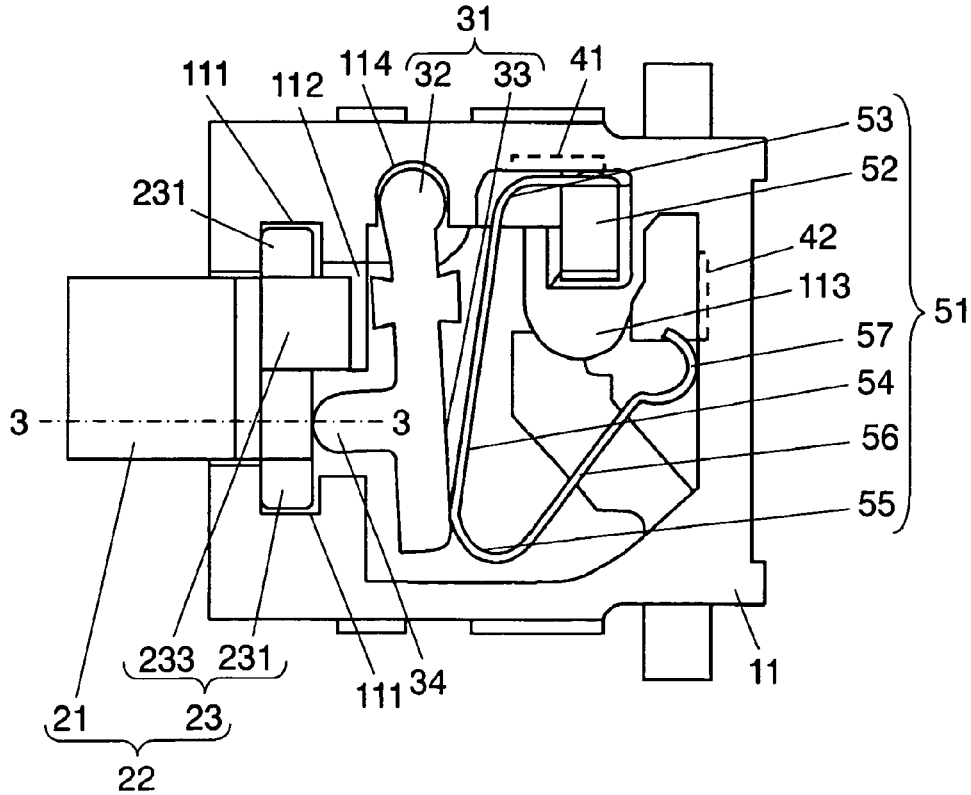
FIG. 2 shows a top view of the switch shown in FIG. 1 without a cover.
Figure 3:
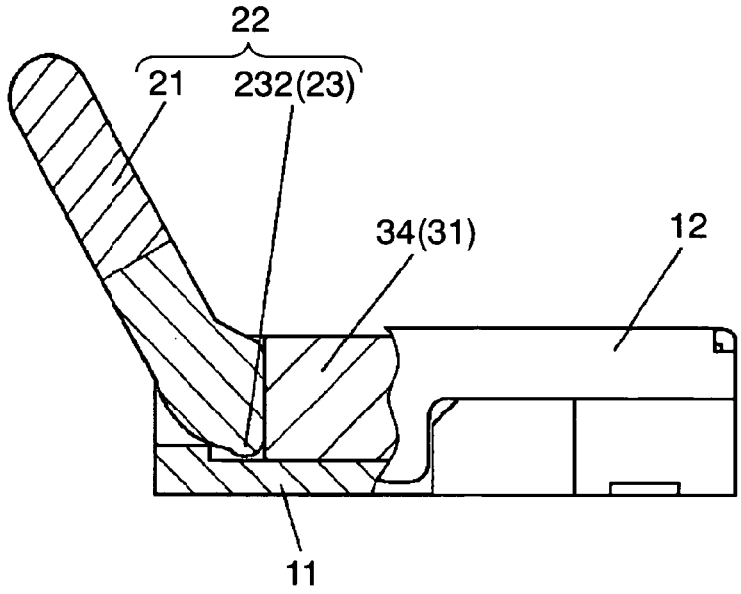
FIG. 3 shows a lateral sectional view, illustrating parts of the switch, taken along the line 3—3 of FIG. 2.

Exemplary embodiments of the present invention are demonstrated hereinafter with reference to the accompanying drawings. FIG. 1 shows a perspective appearance of a switch in accordance with an exemplary embodiment of the present invention. FIG. 2 shows a top view of the switch shown in FIG. 1 without a cover. FIG. 3 shows a lateral sectional view illustrating parts of the switch taken along the line 3—3 of FIG. 2.

In FIG. 1–FIG. 3, box-shaped housing 11, having a recess open upward and made of molded resin, is covered by cover 12 at the top face of its recess. Operating lever 21 shaped like a straight rod projects slantingly upward from the front of housing 11, and lever 21 can be tilted. The side where lever 21 is disposed is referred to as the front of housing 11 and the opposite side is referred to as the rear of housing 11.

Lever 21 works as the operating section of the switch of the present invention, and is made of elastic material such as rubber or elastomer. The root of lever 21 is coupled to operating unit 23 made of insulating resin and disposed in housing 11. Lever 21 and operating unit 23 are unitarily formed as operating member 22.

Operating member 22 is formed unitarily of the foregoing two different materials, and the two-color molding method is suitable for molding operating member 22, so that operating member 22 excellent in connection stability between operating unit 23 and lever 21 can be manufactured with ease at a rather low cost. Operating unit 23 except its part connecting to the root of lever 21 is accommodated in housing 11.

In FIG. 2, operating unit 23 has cylindrical fulcrum section 231 extending horizontally, and fulcrum ends 231 of both sides are rotatably rested in holding recesses 111 formed in housing 11.

Operating unit 23 includes pressing section 232 projecting downward (refer to FIG. 3) and receiving section 233 projecting backward. Pressing section 232 is energized by energizing force of a contacting section of a self-reset switch (detailed later) toward the front via driving bar 31 disposed in housing 11. The energizing force brings the underside of receiving section 233 into contact with the top face of step 112 formed in housing 11, so that operating member 22 is kept resting at a given angle.

The switch contacting sections accommodated in the space surrounded by housing 11 and cover 12 are described hereinafter. As shown in FIG. 2, first contact 41 and second contact 42, both being fixed contacts, are mounted nakedly on the two adjacent inner walls of the recess, respectively.

Contacting slip 51, a movable contact, is formed of elastic metal thin plate and includes U-shaped section 52 at its first end. U-shaped section 52 is rigidly sandwiched by first contact 41 and projection 113, which projects from the bottom face of housing 11 for holding contacting slip 51. The first end of contacting slip 51 thus stays in contact with first contact 41.

Contacting slip 51 is formed of U-shaped section 52, first bowing section 53 and first flat section 54, second bowing section 55, and second flat section 56 in this order. At the tip of second flat section 56, contacting part 57 is prepared. During non-operating state of the switch, contacting part 57 urges against the inner wall, on which second contact 42 is provided, at a place where contacting part 57 does not contact with second contact 42.

When first flat section 54 near second bowing section 55 is pushed backward in response to the operating force applied to lever 21, this contact slip 51 as a whole rotates counter-clockwise using U-shaped section 52 as a fulcrum. This rotation causes movement of contacting part 57 along the rear inner wall of housing 11 to come in contact with second contact 42.

On the other hand, driving bar 31, disposed between pressing section 232 and contacting slip 51, is made of insulating resin and shaped like a rod when it is viewed from the top. Driving bar 31 is placed for moving the contacting slip 51 more steadily. To be more specific, cylindrical supporting projection 32 is provided at a first end of rod-like driving bar 31. Projection 32 protrudes downward and is inserted rotatably in circular hole 114 provided in a wall of housing 11. A section in the vicinity of a second end of driving bar 31 at flat rear face 33 facing contacting slip 51 is brought into contact with first flat section 54 near second bowing section 55 of contacting slip 51. Further, driving bar 31 has projection 34 for being driven. Projection 34 is provided at the front of driving bar 31 and protrudes downward at approximately a center of bar 31. Pressing section 232 of operating member 22 is brought into contact with this projection 34 (refer to FIG. 3).

The switch having the foregoing structure has an operating section, i.e. lever 21, made of elastic material. In other words, lever 21 made of elastic material can bow in every direction. Lever 21 bows when force at least greater than necessary for lever 21 to change the switch contact is applied to lever 21, or force directed along another direction than the operating direction, is applied to lever 21.

Next, an operation of the switch in accordance with the first embodiment is demonstrated. In FIG. 1, when regular operating force is applied to lever 21 downward as an arrow mark indicates, operating member 22 as a whole moves in the following manner: Operating member 22 as a whole rotates downward about cylindrical fulcrum 231 that rests in holding recesses 111 with lever 21 remaining shaped like a straight rod.

Figure 4:
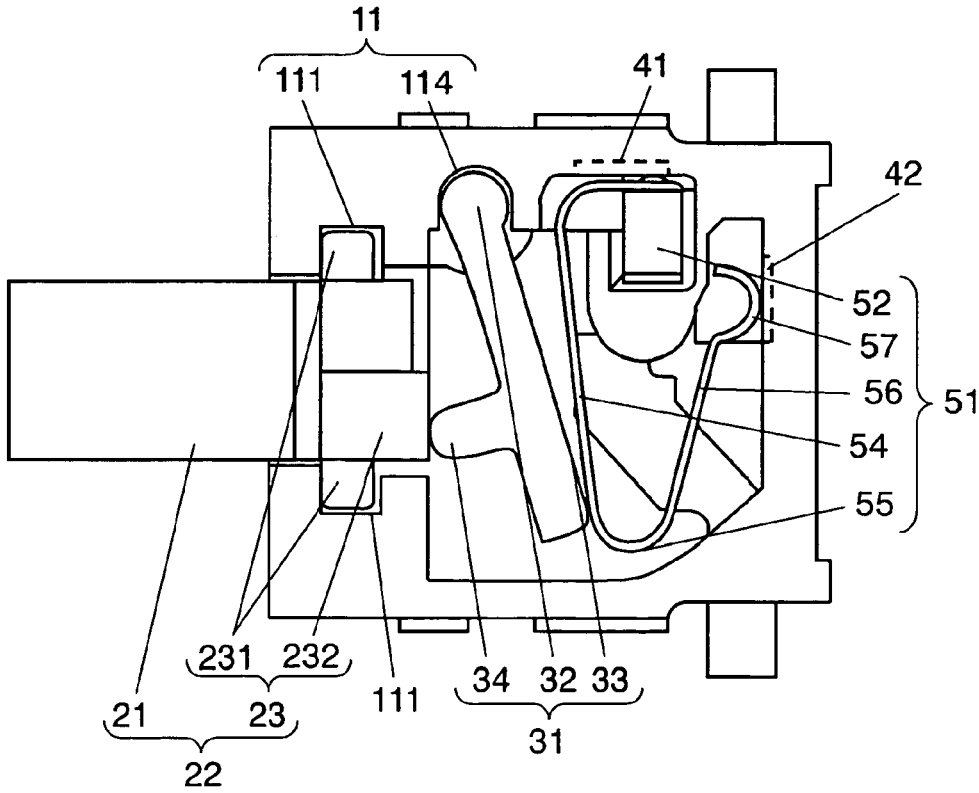
FIG. 4 shows a top view of the switch shown in FIG. 1 without a cover, the switch being under a normal operation.
Figure 5:
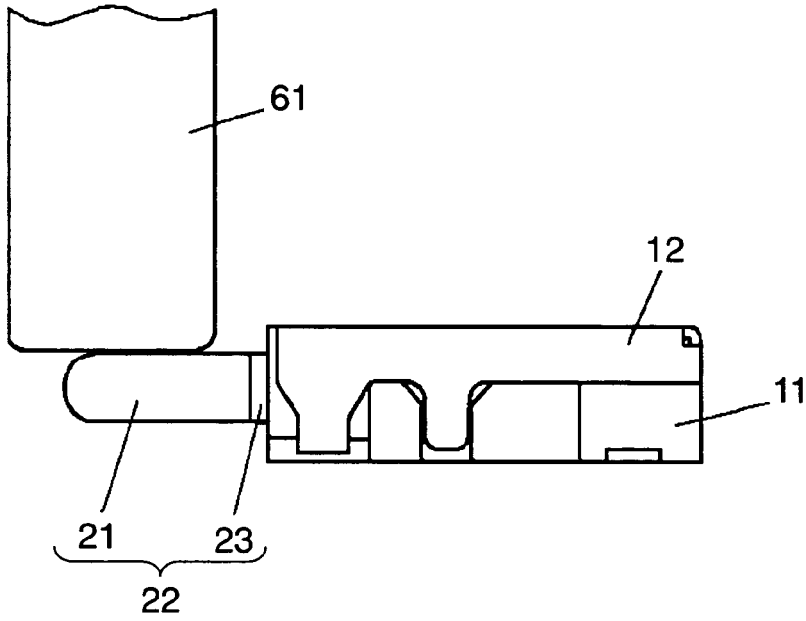
FIG. 5 shows a lateral view illustrating the switch shown in FIG. 1 under the normal operation.

This rotation allows pressing section 232 projecting downward of operating unit 23 shown in FIG. 3 to rotate, thereby pushing driving bar 31 at projection 34 backward. At this time, as shown in FIG. 4, driving bar 31 rotates horizontally and counter-clockwise on supporting projection 32 held in circular hole 114. This rotation allows rear face 33 of driving bar 31 to urge backward against first flat section 54 near second bowing section 55 of contacting slip 51.

In the state shown in FIG. 2, contacting slip 51, except U-shaped section 52 rigidly sandwiched, rotates counter-clockwise as viewed from the top and as shown in FIG. 4, and contacting part 57 of second flat section 56 moves upward along the rear inner wall of housing 11 to second contact 42. As a result, first contact 41 becomes conductive with second contact 42 via contacting slip 51, so that the switch is placed in an ON state.

During this normal operation, while being pressed down by operating button 61 of a device (not shown), lever 21 remains shaped like a straight rod. When the normal operating force is removed, contacting slip 51 returns to its original shape, and the switch is placed in an OFF state, and the self-resetting force of contacting slip 51 rotates driving bar 31 as well as operating member 22 about the respective fulcrums and returns them to their original places.

At this time, the underside of receiving section 233 of operating member 22 is brought into contact with the top face of step 112, so that operating member 22 stops a predetermined angle at the original location in the non-operating state. Operating member 22 then returns to the state before the operation starts. During this returning operation, lever 21 remains in a straight rod shape.

Urging of contacting slip 51 as discussed above via operating unit 23 rigidly made of insulating resin and driving bar 31 thus changes a state of the switch contact. This structure allows the contacting sections to move accurately and steadily.

Figure 6:
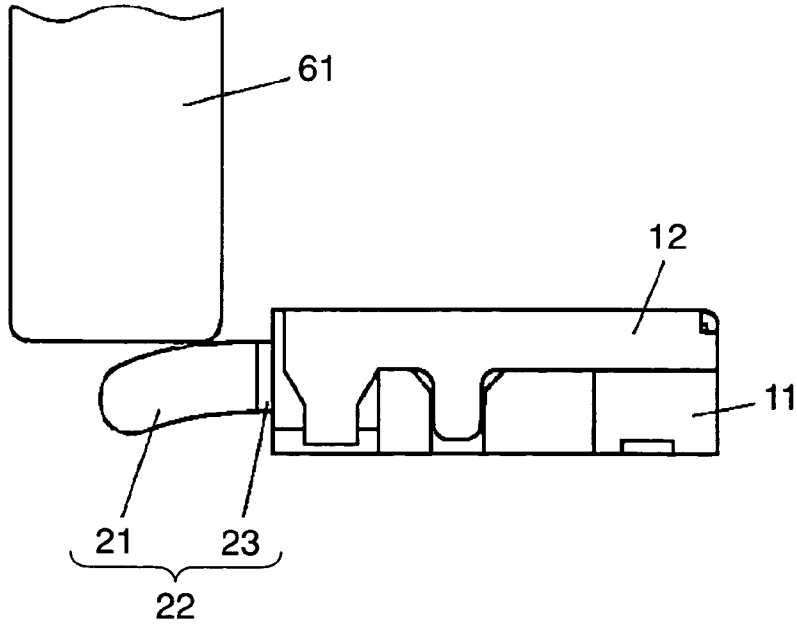
FIG. 6 and FIG. 7 show lateral views illustrating states where excessive force is applied to the operating section.
Figure 7:
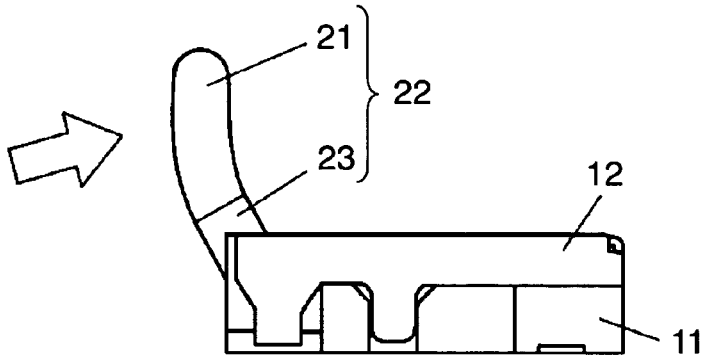

When excessive force is applied to operating button 61 of the device (not shown) in the operating direction, the switch in accordance with this embodiment allows lever 21, made of elastic material such as rubber, to bow along the operating direction as shown in FIG. 6, thereby dispersing the excessive force. In other words, contacting slip 51 moves in the same manner as discussed above due to the force corresponding to the normal operation, and the extra force is absorbed by lever 21 itself.

A force directed other than in the direction of the arrow mark shown in FIG. 1 corresponds to the foregoing excessive force. When such force is applied, operating unit 23 is kept in the non-operating state as shown in FIG. 1–FIG. 3, namely the OFF state of the switch, and only lever 21 bows itself. Removal of the excessive force returns lever 21 to the regular state shown in FIG. 1–FIG. 3.

The force along a direction other than the operating direction as discussed above can be applied in the following cases: when the switch per se is going to be mounted to a printed circuit board of a device; or when a sensing mechanism including the switch is going to be mounted to a device; or when a device employing the switch is dropped carelessly. In the foregoing cases, a conventional switch tends to be broken at its lever when the force along the direction other than the operating direction is applied to the lever, because the force cannot escape or disperse. The switch of the present invention, on the contrary, has lever 21 that can bow so as to absorb the impact of extra force when excessive force is applied. As a result, lever 21 is scarcely damaged, and this structure contributes to the better handling as well as the reduction of assembling steps of devices.

In the foregoing description, lever 21 made of elastic material and operating unit 23 made of insulating resin are unitarily molded by the two-color molding method. However, the operating member as a whole can be formed of only elastic material such as rubber or elastomer. In this case, the operating member can be molded with ease, so that little damage occurs to the operating section. As a result, the switch can be constructed at an inexpensive cost.

Since sections for moving the contacting sections of the switch also have elasticity, when the operating section as a whole is formed of only elastic material, it is important to consider the influence of the elasticity of those sections, which move the contacting sections, for allowing the contacting sections to be switched.

The gist of the present invention is to provide the operating section with elasticity for moderating the excessive force applied to the operating section, thereby reducing damage at the operating section. Therefore, the structure of the switch contacting sections or the method of contacting to or separating from each other cannot be limited to the foregoing description.

Figure 8A:
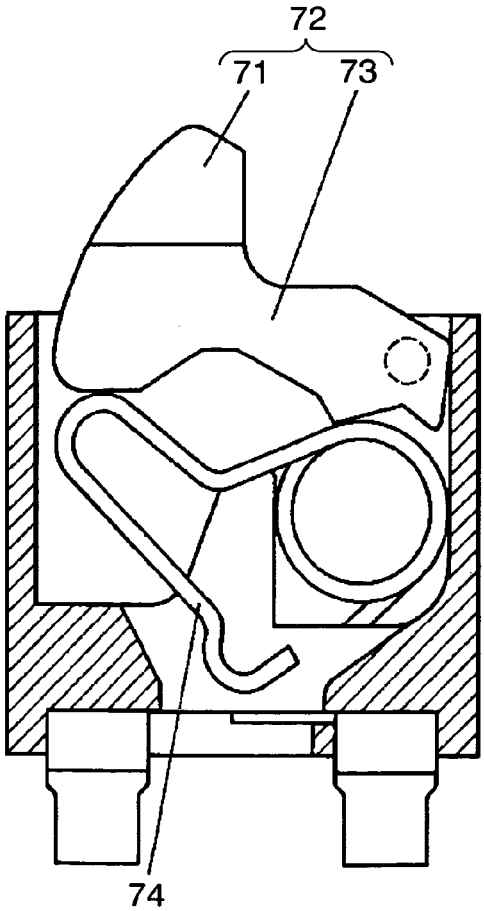
FIG. 8A shows a sectional view illustrating a switch in accordance with another exemplary embodiment of the present invention.
Figure 8B:
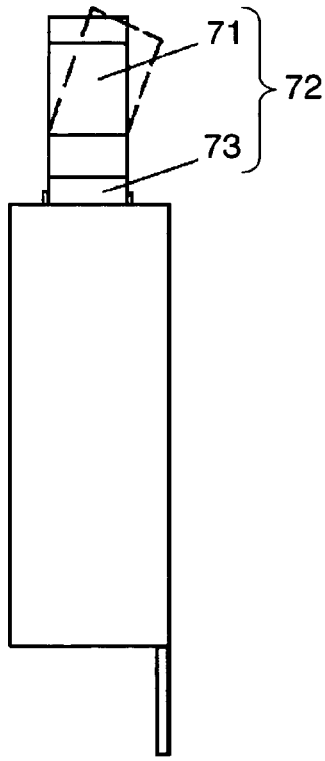
FIG. 8B shows a lateral view of the switch shown in FIG. 8A.
Figure 9:
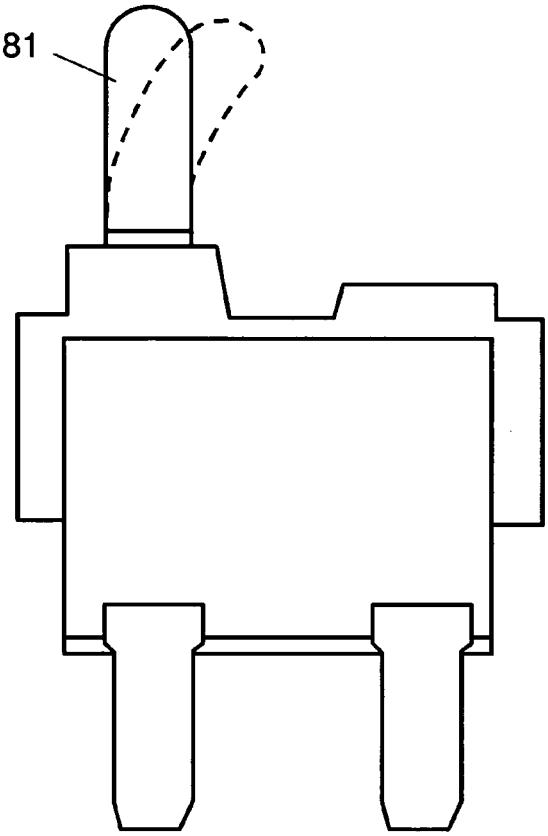
FIG. 9 shows a plan view illustrating a switch in accordance with still another exemplary embodiment of the present invention.
Figure 10:
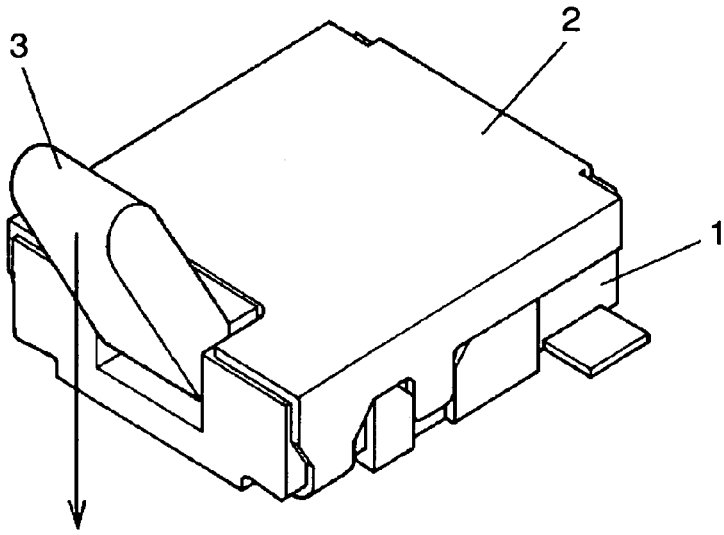
FIG. 10 PRIOR ART
FIG. 10 shows a perspective appearance of a conventional switch.

For instance, a switch shown in FIG. 8A has operating section 71 shaped like a triangular projection having elasticity and unitarily molded with operating unit 73 of operating member 72. Operating unit 73 directly contacts and urges pin 74 formed of a coiled spring. In this switch, operating section 71 per se bows laterally due to excessive force as shown with dotted lines in FIG. 8B. This type of switch can be within the scope of the present invention. Further, operating section 81 of a push switch shown in FIG. 9 bows as shown with broken lines due to excessive operating force, directed in a direction other than the operating direction, in order to absorb the impact of the excessive force. This type of switch can be also within the scope of the present invention.

An operating section formed of an insulating resilient sheet member made of polyimide or polyethylene terephthalate, a leaf spring, or a coil spring can be unitarily molded with an operating unit that moves contacting sections, so that this operating section can bow for itself to absorb extra force. This type of switch is also within the scope of the present invention.

As discussed above, the switch of the present invention is mounted to a variety of electronic devices for a sensing purpose, and if an unexpected load is applied to the operating section, the switch can advantageously avoid damage at the operating section. The switch is thus useful to form a sensing mechanism of a variety of electronic devices.

The operating unit is made of insulating resin and rotatably held on a fulcrum with respect to the housing, and the operating section made of elastic material is unitarily molded with the operating unit. In this switch, if the rotation of the operating unit allows changing of the contact state, the state of the contacting sections changes in response to the rotation of the operating unit made of rigid material. This structure allows the contacting sections to move steadily in switching a switch-state, and excessive force applied to the operating section can be absorbed by the operating section itself.

The two-color and unitary molding of the operating unit and operating section can manufacture the switches to be excellent in stable connection between the operating unit and the operating section and at a rather inexpensive cost.

If the operating member as a whole is formed of elastic material only, it is easy to form the operating member, and damage at the operating section can be prevented, and the switches thus can be provided at a rather inexpensive cost.

What is claimed is:

1. A switch comprising:

a housing having a pair of holding recesses;

a contacting section accommodated in said housing and being changeable between a contacting state for contacting with an electrical contact, and a non-contacting state;

an operating member mounted to said housing for use in changing said contacting section between said contacting state and said non-contacting state;

wherein said operating member includes an operating unit operably coupled with said contacting section and rotatably mounted to said housing for rotation about a fulcrum, said fulcrum having opposing ends supported in said holding recesses of said housing, respectively, such that said operating member is pivotable back and forth in an operation direction;

wherein said operating member further includes an operating section unitarily formed with said operating unit and projecting outside said housing; and wherein said operating section is formed of a flexible elastic material, said elastic material having enough rigidity so that, when a necessary operating force is applied to said operating section in the operation direction, the operating force is transmitted by said operating section to said contacting section via said operating unit to cause changing of said contacting section between said contacting state and said non-contacting state, and said elastic material having enough flexibility so that, when a force greater than the necessary operating force is applied to said operating section in the operation direction or when a force is applied to said operating section in a direction other than the operation direction, said operating section bows elastically so as to absorb applied force.

2. The switch of claim 1, wherein said operating unit is formed of an elastic material.

3. The switch of claim 1, further comprising a driving bar having a pivot part pivotally mounted to said housing, a projection part operably engaged with said operating unit of said operating member, and an engagement part arranged to engage said contacting section.

4. The switch of claim 1, wherein said operating member, said driving bar, and said contacting section are arranged such that, upon application of a necessary operation force to said operating section of said operating member, said operating unit is moved to cause pivoting of said driving bar about said pivot part so that said engagement part of said driving bar pushes said contacting section to change between said non-contacting state and said contacting state.

5. The switch of claim 1, wherein said housing comprises a box-shaped housing having an upwardly-opening recess;

said contacting section is disposed in said upwardly-opening recess; and a cover is provided to cover said upwardly-opening recess.

6. The switch of claim 1, wherein said operating section is constituted by a straight elongated lever.

* * * * *

UNITED STATES PATENT AND TRADEMARK OFFICE

CERTIFICATE OF CORRECTION

PATENT NO. : 7,041,919 B2
APPLICATION NO. : 10/894127
DATED : May 9, 2006
INVENTOR(S) : Kenji Nishimura et al.

It is certified that error appears in the above-identified patent and that said Letters Patent is hereby corrected as shown below:

Col. 7, line 1,
Claim 4 should depend from claim 3 instead of claim 1.

Signed and Sealed this

Ninth Day of January, 2007

JON W. DUDAS
*Director of the United States Patent and Trademark Office*